US009280099B2

(12) United States Patent
Makino et al.

(10) Patent No.: US 9,280,099 B2
(45) Date of Patent: Mar. 8, 2016

(54) IMAGE FORMING APPARATUS HAVING CONVEYING BODY AND TRANSFER UNITS

(71) Applicant: Brother Kogyo Kabushiki Kaisha, Nagoya-shi, Aichi-ken (JP)

(72) Inventors: Masato Makino, Kariya (JP); Yuji Takimoto, Handa (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/520,556

(22) Filed: Oct. 22, 2014

(65) Prior Publication Data

US 2015/0110511 A1 Apr. 23, 2015

(30) Foreign Application Priority Data

Oct. 22, 2013 (JP) ..... 2013-219003

(51) Int. Cl.
*G03G 15/16* (2006.01)
*G03G 15/01* (2006.01)
*G03G 15/00* (2006.01)

(52) U.S. Cl.
CPC ..... *G03G 15/1675* (2013.01); *G03G 15/0142* (2013.01); *G03G 15/16* (2013.01); *G03G 15/6529* (2013.01); *G03G 2215/0141* (2013.01)

(58) Field of Classification Search
CPC ..... G03G 15/1675; G03G 15/0142; G03G 15/6529; G03G 15/16; G03G 2215/0141
See application file for complete search history.

(56) References Cited

U.S. PATENT DOCUMENTS

| | | | | |
|---|---|---|---|---|
| 5,276,483 | A * | 1/1994 | Hasegawa et al. | 399/44 |
| 5,512,983 | A * | 4/1996 | Fukushima et al. | 399/153 |
| 5,589,922 | A * | 12/1996 | Amemiya et al. | 399/315 |
| 5,983,044 | A * | 11/1999 | Kodama et al. | 399/49 |
| 2001/0051055 | A1 | 12/2001 | Omata et al. | |
| 2004/0234287 | A1 * | 11/2004 | Nishida et al. | 399/66 |
| 2014/0321874 | A1 * | 10/2014 | Sugiura et al. | 399/71 |

FOREIGN PATENT DOCUMENTS

| | | | |
|---|---|---|---|
| JP | H09-218592 | A | 8/1997 |
| JP | 2001-350353 | A | 12/2001 |
| JP | 2011-209361 | A | 10/2011 |
| JP | 2011209361 | A * | 10/2011 |

* cited by examiner

*Primary Examiner* — Ryan Walsh
(74) *Attorney, Agent, or Firm* — Banner & Witcoff, Ltd.

(57) ABSTRACT

An image forming apparatus includes a first transfer unit and a second transfer unit, and a control device. If a prescribed condition is satisfied, the control device sets a transfer current value for the second transfer unit so that an absolute value of a difference between the first current value and a second current value is greater than an absolute value of a difference between a third current value and a fourth current value. The first current value is set in a black-white mode, in which an image is formed by using black toner only, under the prescribed condition; the second current value is set if the prescribed condition is unsatisfied in the black-white mode; the third current value is set in a multi color mode, in which an multi-color image is formed, under the prescribed condition; and the fourth current value is set if the prescribe condition is unsatisfied in the multi color mode.

8 Claims, 10 Drawing Sheets

FIG. 4

NORMAL ENVIRONMENT CURRENT VALUE TABLE

| | MODE | YELLOW | MAGENTA | CYAN | BLACK |
|---|---|---|---|---|---|
| CURRENT VALUE | BLACK- WHITE MODE | -3 μA | -3 μA | -3 μA | -12 μA (SECOND CURRENT VALUE) |
| | MULTI COLOR MODE | -8 μA | -10 μA | -10 μA | -12 μA (FOURTH CURRENT VALUE) |

FIG. 5

SPECIAL ENVIRONMENT CURRENT VALUE TABLE (1)

| | MODE | YELLOW | MAGENTA | CYAN | BLACK |
|---|---|---|---|---|---|
| CURRENT VALUE | BLACK-WHITE MODE | -3 μA | -3 μA | -3 μA | -15 μA |
| | MULTI COLOR MODE | -10 μA | -12 μA | -12 μA | -15 μA (THIRD CURRENT VALUE) |

FIG. 7

CURRENT VALUE SPECIALLY CHANGING TABLE

| | MODE | YELLOW | MAGENTA | CYAN | BLACK |
|---|---|---|---|---|---|
| CURRENT VALUE | BLACK-WHITE MODE | -3 μA | -3 μA | -3 μA | -20 μA (FIRST CURRENT VALUE) |
| | MULTI COLOR MODE | -10 μA | -12 μA | -12 μA | -15 μA (THIRD CURRENT VALUE) |

FIG. 9

SPECIAL ENVIRONMENT CURRENT VALUE TABLE (2)

| | MODE | YELLOW | MAGENTA | CYAN | BLACK |
|---|---|---|---|---|---|
| CURRENT VALUE | BLACK-WHITE MODE | -3 μA | -3 μA | -3 μA | -20 μA (FIRST CURRENT VALUE) |
| | MULTI COLOR MODE | -10 μA | -12 μA | -12 μA | -15 μA (THIRD CURRENT VALUE) |

FIG. 10

NORMAL ENVIRONMENT CURRENT VALUE TABLE

| | MODE | BLACK | YELLOW | MAGENTA | CYAN |
|---|---|---|---|---|---|
| CURRENT VALUE | BLACK-WHITE MODE | -8 μA | -3 μA | -3 μA | -12 μA (FOURTH CURRENT VALUE) |
| | MULTI COLOR MODE | -8 μA | -10 μA | -10 μA | -12 μA (SECOND CURRENT VALUE) |

FIG. 11

SPECIAL ENVIRONMENT CURRENT VALUE TABLE

| | MODE | BLACK | YELLOW | MAGENTA | CYAN |
|---|---|---|---|---|---|
| CURRENT VALUE | BLACK-WHITE MODE | -10 μA | -3 μA | -3 μA | -15 μA (THIRD CURRENT VALUE) |
| | MULTI COLOR MODE | -10 μA | -12 μA | -12 μA | -20 μA (FIRST CURRENT VALUE) |

FIG. 12A

NORMAL ENVIRONMENT CURRENT VALUE TABLE

| | MODE | FIRST | SECOND | THIRD | FOURTH (MOST DOWNSTREAM) |
|---|---|---|---|---|---|
| CURRENT VALUE | SINGLE COLOR MODE | -3μA | -3μA | -3μA | −12μA |
| | MULTI COLOR MODE | -8μA | -10μA | -10μA | −12μA |

FIG. 12B

SPECIAL ENVIRONMENT CURRENT VALUE TABLE

| | MODE | FIRST | SECOND | THIRD | FOURTH (MOST DOWNSTREAM) |
|---|---|---|---|---|---|
| CURRENT VALUE | SINGLE COLOR MODE | -3μA | -3μA | -3μA | -15μA |
| | MULTI COLOR MODE | -10μA | -12μA | -12μA | −15μA |

FIG. 12C

CURRENT VALUE SPECIALLY CHANGING TABLE

| | MODE | FIRST | SECOND | THIRD | FOURTH (MOST DOWNSTREAM) |
|---|---|---|---|---|---|
| CURRENT VALUE | SINGLE COLOR MODE | -3μA | -3μA | -3μA | −20μA |
| | MULTI COLOR MODE | -10μA | -12μA | -12μA | −20μA |

FIG. 13A

MULTI-COLOR-MODE CURRENT VALUE TABLE

| | MODE | FIRST | SECOND | THIRD | FOURTH (MOST DOWN-STREAM) |
|---|---|---|---|---|---|
| CURRENT VALUE | MULTI COLOR MODE | -8μA | -10μA | -10μA | -12μA |

FIG. 13B

SINGLE-COLOR-MODE CURRENT VALUE TABLE

| | MODE | FIRST | SECOND | THIRD | FOURTH (MOST DOWN-STREAM) |
|---|---|---|---|---|---|
| CURRENT VALUE | SINGLE COLOR MODE | -3μA | -3μA | -3μA | -15μA |

FIG. 13C

SINGLE-COLOR-MODE CURRENT VALUE SPECIALLY CHANIGNG TABLE

| | MODE | FIRST | SECOND | THIRD | FOURTH (MOST DOWN-STREAM) |
|---|---|---|---|---|---|
| CURRENT VALUE | SINGLE COLOR MODE | -3μA | -3μA | -3μA | -20μA |

IMAGE FORMING APPARATUS HAVING CONVEYING BODY AND TRANSFER UNITS

CROSS REFERENCE TO RELATED APPLICATIONS

This application claims priority from Japanese Patent Application No. 2013-219003 filed Oct. 22, 2013. The entire content of the priority application is incorporated herein by reference.

TECHNICAL FIELD

The present invention relates to an image forming apparatus, and more particularly to a technique for controlling transfer current during image formation.

BACKGROUND

Japanese Patent Application Publication No. 2001-350353 discloses a transfer current controlling during image formation. This publication discloses a technique for controlling a tandem-type configuration in which a black process unit is disposed at the most downstream position among a plurality of process units. When image formation is executed in the black-white mode, transfer currents are controlled such that the transfer current for black (K) is set to 12 microamperes (μA), and the transfer currents for yellow, magenta, and cyan are set to substantially 0 (zero) microampere (μA).

SUMMARY

In the above-described tandem-type configuration, a sheet onto which an image of developer has been transferred thereon is separated from a conveyer and is fed to a fixing device. When the sheet is separated from the conveyer, however, electric discharge sometimes occurs. The electric discharge could effect a developer image of the most downstream color, which has been transferred last onto the sheet among the plurality of colors and therefore which has been transferred on top of the developer images of the other colors, thereby affecting a resultant image.

In order to solve this problem, it is conceivable to increase, from a preset amount, the amount of the transfer current to be applied to the most downstream transfer roller, thereby increasing the amount of force for attracting the developer of the most downstream color onto the sheet. This can restrain the effects of the electric discharge onto the developer image. However, the preset amount of the transfer current has been previously set as such an amount that is optimal for forming an image of high quality. The increased current value is therefore not optimal for forming an image of high quality. Therefore, it is improper to use the increased transfer current value, even though the increased current value can reduce the effects of the electric discharge.

The present invention is intended to provide a technique for suppressing, when necessary, the electric discharge from affecting the image quality during the sheet separation from the conveyer.

In order to attain the above and other objects, the present invention provides an image forming apparatus that may include a conveying body, a plurality of photosensitive bodies, a plurality of transfer units, and a control device. The conveying body may be configured to convey a sheet in a conveying direction. The conveying body may have a surface to support the sheet thereon. The plurality of photosensitive bodies may be configured to be arranged facing the surface of the conveying body. The plurality of photosensitive bodies include a first photosensitive body and a second photosensitive body. The first photosensitive body may be configured to bear thereon a developer image in a predetermined color. The second photosensitive body may be configured to bear thereon a developer image in black and positioned at a most downstream position among the plurality of the photosensitive bodies in the conveying direction. The plurality of transfer units may be provided in one to one correspondence with the plurality of photosensitive bodies. The transfer units may include a first transfer unit and a second transfer unit. The first transfer unit may be disposed corresponding to the first photosensitive body and configured to transfer the developer image in the predetermined color from the first photosensitive body to the sheet supported on the conveying body. The second transfer unit may be disposed corresponding to the second photosensitive body and configured to transfer the developer image in black from the second photosensitive body to the sheet supported on the conveying body. The control device may be configured to perform: determining whether a condition that an electric discharge occurring during separation from the conveying body of the sheet, onto which a developer image has been transferred, is likely to affect an image quality is satisfied; setting a first current value so that an absolute value of a difference between the first current value and a second current value is greater than an absolute value of a difference between a third current value and a fourth current value; and forming an image by using the first current value in the black-white mode. The first through fourth current values may be defined as amounts of transfer currents to be applied to the second transfer unit. The first current value may be for a case where a black-white mode is set and the condition is satisfied. The second current value may be for a case where the black-white mode is set and the condition is unsatisfied. The third current value may be for a case where the multi color mode is set and the condition is satisfied. The fourth current value may be for a case where the multi color mode is set and the condition is unsatisfied. The black-white mode may be defined as a mode where a developer image is formed by using developer in black only. The multi color mode may be defined as a mode where a developer image is formed by using developer in a plurality of colors including the predetermined color and the black.

According to another aspect, the present invention provides an image forming apparatus that may include a conveying body, a plurality of photosensitive bodies, a plurality of transfer units, and a control device. The conveying body may be configured to convey a sheet in a conveying direction. The conveying body may have a surface to support the sheet thereon. The plurality of photosensitive bodies may be configured to be arranged facing the surface of the conveying body. The plurality of photosensitive bodies may include a first photosensitive body and a second photosensitive body. The first photosensitive body may be configured to bear thereon a developer image in black. The second photosensitive body may be configured to bear thereon a developer image in a predetermined color and positioned at a most downstream position among the plurality of the photosensitive bodies in the conveying direction. The plurality of transfer units are provided in one to one correspondence with the plurality of photosensitive bodies. The transfer units may include the first and second transfer units. The first transfer unit may be disposed corresponding to the first photosensitive body and configured to transfer the developer image in black from the first photosensitive body to the sheet supported on the conveying body. The second transfer unit may be disposed corresponding to the second photosensitive body and configured to transfer the developer image in the predetermined color from the second photosensitive body to the sheet supported on the conveying body. The control device may be configured to perform: determining whether a condition that an electric discharge occurring during separation from the conveying body of the sheet, onto which a developer image has been transferred, is likely to affect an image quality is satisfied; setting a first current value so that an absolute value of a difference between the first current value and a second current value is greater than an absolute value of a difference between a third current value and a fourth current value; and forming an image by using the first current value in the black-white mode. The first through fourth current values may be defined as amounts of transfer currents to be applied to the second transfer unit. The first current value may be for a case where a multi color mode is set and the condition is satisfied. The second current value may be for a case where the multi color mode is set and the condition is unsatisfied. The third current value may be for a case where the black-white mode is set and the condition is satisfied. The fourth current value may be for a case where the black-white mode is set and the condition is unsatisfied. The black-white mode may be defined as a mode where a developer image is formed by using developer in black only. The multi color mode may be defined as a mode where a developer image is formed by using developer in a plurality of colors including the predetermined color and the black.

According to another aspect, the present invention provides an image forming apparatus that may include a conveying body, a plurality of photosensitive bodies, a plurality of transfer units, an operational unit, and a control device. The conveying body may be configured to convey a sheet in a conveying direction. The conveying body may have a surface to support the sheet thereon. The plurality of photosensitive bodies may be configured to be arranged facing the surface of the conveying body. The plurality of photosensitive bodies may include a first photosensitive body and a second photosensitive body. The first photosensitive body may be configured to bear thereon a developer image in a first color. The second photosensitive body may be configured to bear thereon a developer image in a second color and positioned at a most downstream position among the plurality of the photosensitive bodies in the conveying direction. The plurality of transfer units may be provided in one to one correspondence with the plurality of photosensitive bodies. The transfer units may include a first transfer unit and a second transfer unit. The first transfer unit may be disposed corresponding to the first photosensitive body and configured to transfer the developer image in the first color from the first photosensitive body to the sheet supported on the conveying body. The second transfer unit may be disposed corresponding to the second photosensitive body and configured to transfer the developer image in the second color from the second photosensitive body to the sheet supported on the conveying body. The control device may be configured to perform: determining whether a condition that an electric discharge occurring during separation from the conveying body of the sheet, onto which a developer image has been transferred, is likely to affect an image quality is satisfied; if the current value setting request is received and the condition is satisfied, setting the transfer current value for the second transfer unit to such a value that is greater than a transfer current value that is set for the case where the current value setting request is not received and the condition is satisfied; and forming an image by using the transfer current value.

BRIEF DESCRIPTION OF THE DRAWINGS

In drawings:

FIG. 4 is a table (normal environment current value table) showing an example of transfer current values for a normal environment (default settings) according to the first example;

FIG. 5 is a table (special environment current value table (1)) showing an example of transfer current values for a special environment according to the first example;

FIG. 7 is a table (current value specially changing table) showing an example of transfer current values to be used for specially changing transfer currents according to the second example;

FIG. 9 is a table (special environment current value table (2)) showing an example of transfer current values for a special environment according to the third example;

FIG. 10 is a table (normal environment current value table) showing an example of transfer current values for a normal environment according to a modification (1);

FIG. 11 is a table (special environment current value table) showing an example of transfer current values for a special environment according to the modification (1);

FIG. 12A is a table (normal environment current value table) showing an example of transfer current values for a normal environment according to a modification (3);

FIG. 12B is a table (special environment current value table) showing an example of transfer current values for a special environment according to the modification (3);

FIG. 12C is a table (current value specially changing table) showing an example of transfer current values to be used for specially changing transfer currents according to the modification (3);

FIG. 13A is a table (multi-color-mode current value table) showing an example of transfer current values for a multi color mode according to the modification (3);

FIG. 13B is a table (single-color-mode current value table) showing an example of transfer current values for a single color mode according to the modification (3); and FIG. 13C is a table (single-color-mode current value specially changing table) showing an example of transfer current values for a single color mode to be used for specially changing transfer current values according to the modification (3).

DETAILED DESCRIPTION

Embodiment

A laser printer 1 according to an embodiment of the present invention will be described with reference to FIGS. 1 to 9.

1. Overall Configuration

Figure 1:
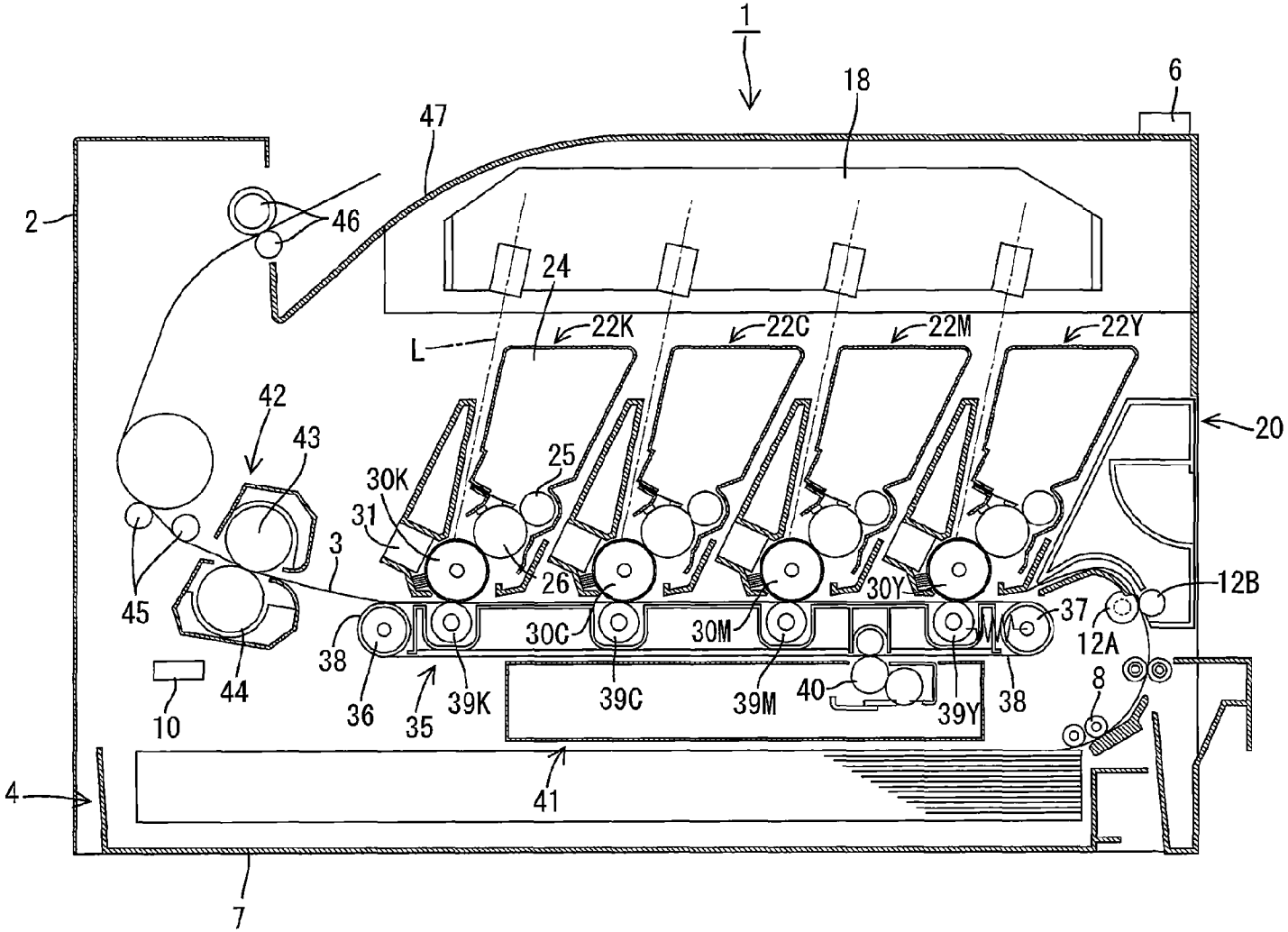
FIG. 1 is a schematic side cross-sectional view showing a structure of an image forming apparatus according to an embodiment of the present invention.

As shown in FIG. 1, the laser printer 1, serving as an example of an image forming apparatus, is a so-called direct tandem-type color laser printer that includes four photosensitive drums 30 for four colors, e.g., black (K), cyan (C), magenta (M), and yellow (Y). Incidentally, the image forming apparatus is not limited to the color laser printer. For example, the image forming apparatus may be a color LED printer or a black and white printer, or may be a so-called multifunction machine with a copy function.

The laser printer (simply referred to as "printer," hereinafter) 1 includes in a main body casing 2: a sheet feed unit 4, a scanner unit 18, an image formation unit 20, and a sheet conveying unit 35. The sheet feed unit 4 feeds a sheet 3, onto which an image is to be formed. The scanner unit 18 exposes the photosensitive drums 30 to laser beams. The image formation unit 20 forms an image on the fed sheet 3. The sheet conveying unit 35 conveys the sheet 3 to the image formation unit 20 and is one example of a conveying body. Incidentally, in the description below, the right side in FIG. 1 is referred to as a front side of the printer 1. Examples of the sheet include a paper and a sheet for an overhead projector (OHP sheet).

The sheet feed unit 4 is disposed inside the main body casing 2 at a bottom portion thereof, and includes a sheet feed tray 7, a pickup roller 8, and a pair of registration rollers 12A and 12B. A top sheet 3 in the sheet feed tray 7 is picked up upon rotation of the pickup roller 8, and is conveyed to the registration rollers 12A and 12B. After registering of the sheet 3, the registration rollers 12A and 12B feed the sheet 3 onto a conveyor belt 38 of the sheet conveying unit 35.

The scanner unit 18 is provided inside the main body casing 2 at an uppermost portion thereof. The scanner unit 18 emits a laser beam L for each color based on image data to the surface of a corresponding photosensitive drum 30.

The image formation unit 20 includes the photosensitive drums 30, scorotron chargers 31, and four developing cartridges (22K, 22C, 22M, and 22Y). Each developing cartridge 22 includes a toner storage chamber 24 in which toner (an example of a developer) is stored, a supply roller 25, and a developing roller 26. In order to develop an image on the photosensitive drum 30, toner is discharged from the toner storage chamber 24, and then is supplied to the developing roller 26 as the rotation of the supply roller 25.

Each scorotron charger 31 includes a charging wire that generates a corona discharge, which uniformly charges the surface of the corresponding photosensitive drum 30 to a positive polarity, for example. While being rotated, the surface of the photosensitive drums 30 is uniformly and positively charged by the corresponding scorotron charger 31 at +900 volts (V), for example. Then, the surface of the photosensitive drum 30 is exposed to a high-speed scanning laser beam emitted from the scanner unit 18, thereby lowering the potential of the surface to +100 volts (V), for example. In this manner, an electrostatic latent image that corresponds to an image to be formed on the sheet 3 is formed on the surface of the photosensitive drum 30.

The toner on the developing roller 26 is positively charged to +450 volts (V), for example. As the developing roller 26 rotates, the toner on the developing roller 26 faces and comes in contact with the photosensitive drum 30, and is supplied to the electrostatic latent image formed on the surface of the photosensitive drum 30. As a result, the electrostatic latent image formed on the photosensitive drum 30 is developed into a visible toner image.

Next, the sheet 3 conveyed by the conveyor belt 38 passes through a transfer position (nip section) between the photosensitive drum 30 and the transfer roller 39. Then, the toner image formed on the surface of the photosensitive drum 30 is transferred to the sheet 3 due to a negative transfer bias (e.g., −700 V) applied to the transfer roller 39. In this manner, the toner image is transferred to the sheet 3 while the sheet 3 is being conveyed on the conveyor belt 38 rearwardly in a horizontal direction, and then the sheet 3 is fed to a fixing unit 42 which is disposed diagonally upward and rearward of the sheet conveying unit 35.

The photosensitive drums 30Y, 30M, 30C, and 30K are one example of a plurality of photosensitive bodies. The photosensitive drums 30Y, 30M, and 30C are one example of first photosensitive bodies. The photosensitive drum 30K is one example of a second photosensitive body.

The transfer rollers 39Y, 39M, 39C, and 39K are one example of a plurality of transfer units. The transfer rollers 39Y, 39M, and 39C are one example of first transfer units. The transfer roller 39K is one example of a second transfer unit.

The fixing unit 42 includes a heating roller 43 and a pressure roller 44, which confront with each other. The fixing unit 42 is for thermally fixing the toner image that has been transferred onto the sheet 3 to the surface of the sheet 3. After the image is thermally fixed onto the sheet 3, the sheet 3 is fed by conveying rollers 45 to sheet discharge rollers 46, and then is discharged by the sheet discharge rollers 46 onto a sheet discharge tray 47. Thus, the sheets 3 with images formed thereon are stacked on the sheet discharge tray 47.

The sheet conveying unit 35 is disposed below the image formation unit 20. The sheet conveying unit 35 includes a pair of belt support rollers 36 and 37 and the conveyor belt (which is one example of a conveying body) 38. The belt support rollers 36 and 37 are provided on the rear and front sides, and are spaced away from and in parallel to each other. The conveyor belt 38 is stretched over the two rollers 36 and 37.

On an inner surface of the conveyor belt 38, the four transfer rollers 39 are provided. The four transfer rollers 39 are disposed so that each of the transfer rollers 39 confronts a corresponding photosensitive drum 30 with the conveyor belt 38 being sandwiched therebetween. The belt cleaning unit 41 is provided below the conveyor belt 38. The belt cleaning unit 41 includes a cleaning roller 40 for removing the remaining toner that adheres to the surface of the conveyor belt 38.

On the top portion of the main body casing 2, an operation panel (which is one example of an operation unit) 6 is provided. The operational panel 6 includes operation buttons, through which a user can input his/her printing instructions and other instructions, and a display section. By operating the operation panel 6, a user can set a print mode to a black-white mode or a multi color mode. In this case, the black-white mode is a print mode, in which the printer 1 uses only the developer of black (K) to form an image. The multi color mode is a print mode, in which the printer 1 uses developer of a plurality of colors, including cyan (C), magenta (M), yellow (Y), and black (K) to form an image. Cyan (C), magenta (M), and yellow (Y) are one example of predetermined colors. In the main body casing 2, a humidity sensor 10 is provided to detect humidity inside the printer 1.

2. Configuration of High-Voltage Generation Circuit

The printer 1 includes four high-voltage generation circuits 60 in one to one correspondence with the four transfer rollers 39. Each high-voltage generation circuit 60 is for generating a transfer voltage Vt to be applied to the corresponding transfer roller 39. The printer 1 is further provided with a CPU 61 (which is one example of a control device) and a memory 65. The CPU 61 is connected to the four high-voltage generation circuits 60. The CPU 61 is also connected to the humidity sensor 10. Incidentally, the control device is not limited to CPU. For example, the control device may be ASIC (application-specific IC), or a combination of ASIC and CPU.

Figure 2:
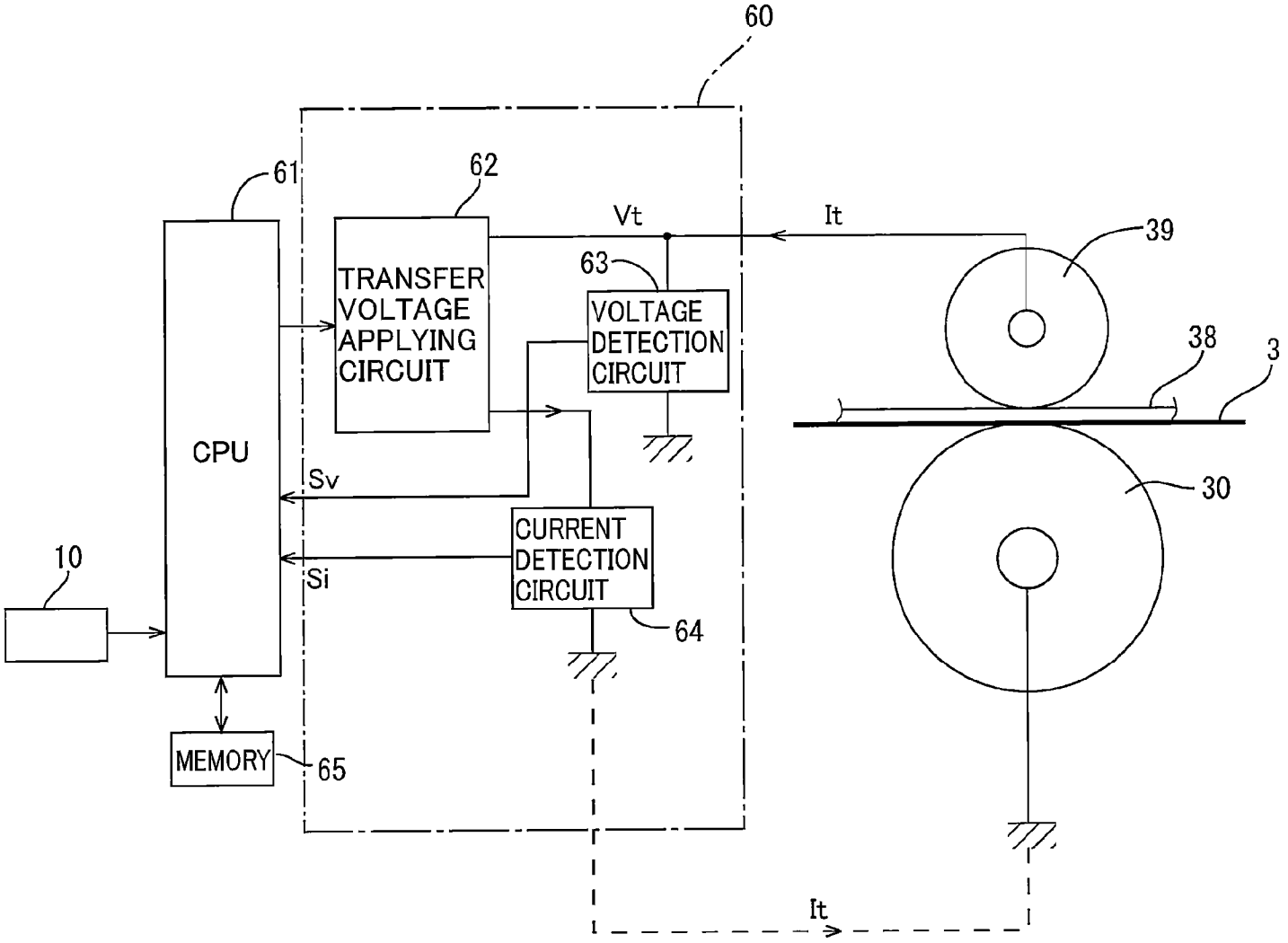
FIG. 2 is a block diagram showing a structure of a high-voltage generation circuit according to an embodiment of the present invention.

FIG. 2 shows one of the four high-voltage generation circuits 60. The other high-voltage generation circuits 60 have the same configuration with the high-voltage generation circuits 60 shown in FIG. 2. The printer 1 is further provided with one or more high-voltage generation circuits for generating high voltages to be applied to the developing rollers 26, scorotron chargers 31, and cleaning roller 40.

As shown in FIG. 2, the high-voltage generation circuit 60 includes a transfer voltage applying circuit 62, a voltage detection circuit 63, and a current detection circuit 64.

For example, the transfer voltage applying circuit 62 includes a PWM signal smoothing circuit, a step-up transformer, and a smoothing rectifier circuit. Based on a PWM (Pulse Width Modulation) signal from the CPU 61, constant-current control is performed on the transfer voltage applying circuit 62. During a normal transfer control operation, for example, a negative high voltage, or −700 volts (V), is generated as transfer voltage Vt. The transfer voltage Vt is applied to the conveyor belt 38 via the transfer roller 39. Since the transfer voltage Vt is a negative voltage, transfer current It flows from the transfer voltage applying circuit 62 to the current detection circuit 64, the ground, the photosensitive drum 30, the conveyor belt 38, and then to the transfer roller 39, as shown in FIG. 2. Hereinafter, the transfer current It flowing in the direction shown in FIG. 2 will be referred to as a negative (minus) current, and the current value of the transfer current It will be indicated by "−10 μA," for example.

The voltage detection circuit 63 includes a dividing resistor, for example. The voltage detection circuit 63 divides the transfer voltage Vt to generate a voltage detection signal Sv, and supplies the voltage detection signal Sv to the CPU 61. The current detection circuit 64 includes two dividing resistors, for example, that are connected between the ground and a secondary winding in a step-up transformer provided in the transfer voltage applying circuit 62. The current detection circuit 64 generates a current detection signal (voltage signal) Si at a position between the dividing resistors, and supplies the current detection signal Si to the CPU 61.

The memory 65 stores programs executed by the CPU 61 and data used by the executed program. For example, a program of a transfer current setting process which will be described later with reference to FIG. 3, a "normal environment current value table" shown in FIG. 4, and a "special environment current value table (1)" shown in FIG. 5 are stored in the memory 65. The memory 65 may be ROM, RAM, or EEPROM.

Normally, during a transfer control operation, the CPU 61 receives the current detection signal (feedback signal) Si, and controls the transfer voltage applying circuit 62 to maintain the current detection signal Si at a predetermined value. In this manner, the constant-current control is performed on the transfer current It. That is, the CPU 61 controls the transfer voltage applying circuit 62 to generate the transfer voltage Vt so that the transfer current It becomes constant. The CPU 61 also controls the transfer voltage applying circuit 62 to carry out a transfer current setting process (described later). Moreover, the CPU 61 controls each part of the printer 1 for image formation.

3. Transfer Current Setting Process

With reference to FIGS. 3 to 9, the transfer current setting process according to first through third examples executed by the CPU 61 will be described below. The CPU 61 starts executing the transfer current setting process, when the CPU 61 receives user's print command from the operation panel 6, for example.

3-1. First Example

Figure 3:
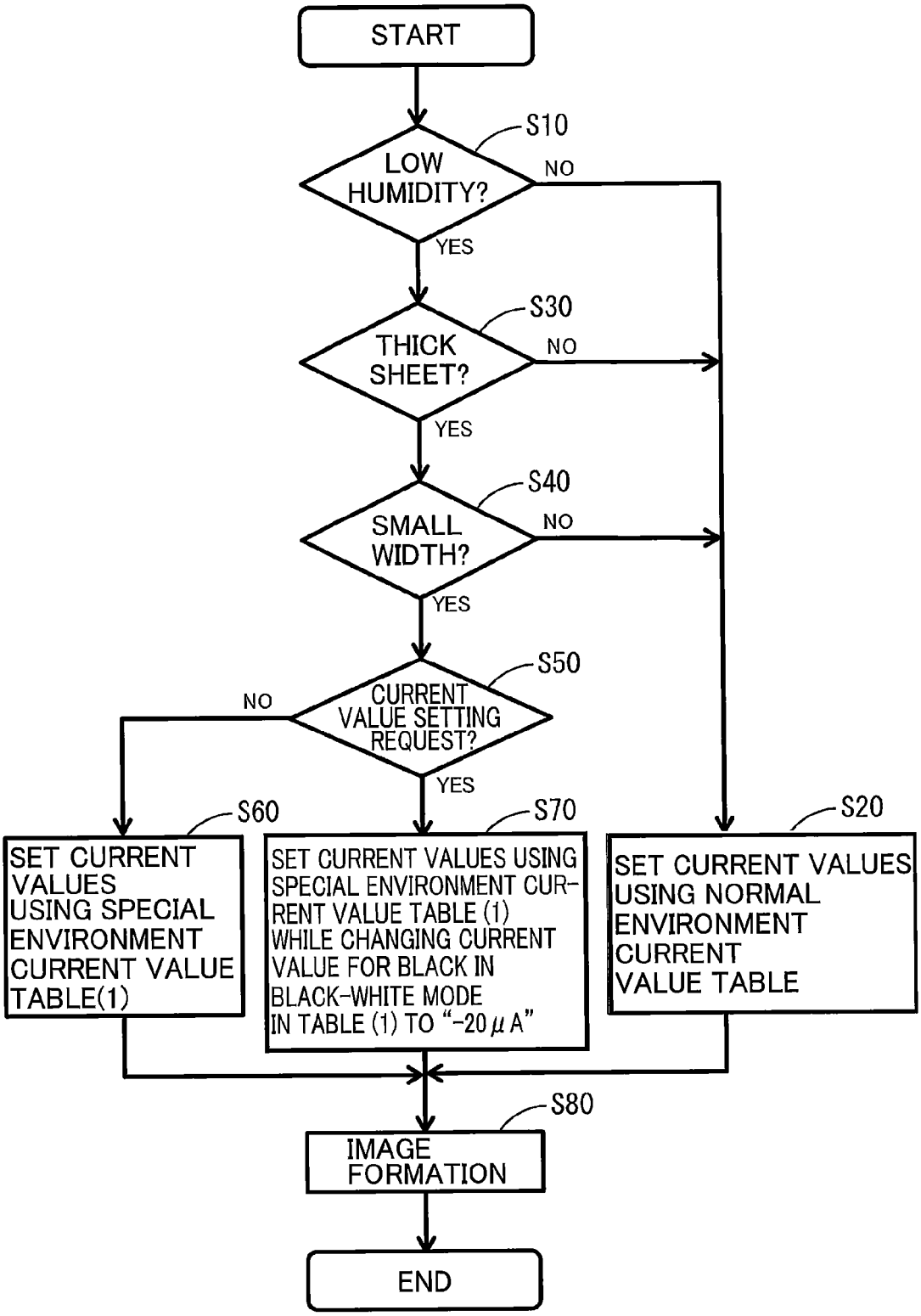
FIG. 3 is a flowchart illustrating steps in a transfer current setting process according to a first example.

First, with reference to FIGS. 3 to 5, the transfer current setting process according to the first example will be described. In the transfer current setting process, as shown in FIG. 3, the CPU 61 first determines in S10 whether or not humidity in the printer 1 is low, based on a detection signal outputted from the humidity sensor 10.

In this case, the humidity in the printer 1 being low is one example of "a condition that an electric discharge that occurs when a sheet, on which developer has been transferred, separates away from the conveyer belt 38 is likely to affect the image quality." This condition will be referred to as "special environment condition," hereinafter. The CPU 61 determines in S10 whether or not the special environment condition is satisfied. For example, the humidity being low means that the humidity is less than 40%. The humidity being medium means that the humidity is greater than or equal to 40% and less than 80%. The humidity being high means that the humidity is greater than or equal to 80%.

If it is determined that the humidity in the printer 1 is not low (S10: NO), or if it is determined that the humidity in the printer 1 is medium or high, the CPU 61 sets the transfer current It for each color in S20 based on the type of the print mode set for the present print job, i.e. black-white mode or multi color mode and by using the "normal environment (default setting) current value table" shown in FIG. 4.

In S80, The CPU 61 controls the transfer voltage applying circuit 62 for each color by using the current value set in S20, and controls the image formation unit 20 to carry out an image formation process to form an image on the sheet 3.

In the normal environment current value table shown in FIG. 4, the transfer current values for the transfer roller 39K are set to the same value of "−12 μA" both in the black-white mode and in the multi color mode. So in S20, the CPU 61 sets a second current value for the black-white mode and a fourth current value for the multi color mode. The second current value and the fourth current value are set to the same value, e.g. "−12 μA", as shown in FIG. 4. As a result, in the normal environment where the special environment condition is not satisfied, the image quality is maintained unchanged between the black-white and multi color modes. It is noted that the transfer current values for the transfer roller 39K are not necessarily equal in the black-white and multi color modes, but may have some amount of difference, e.g. approximately "−1 μA" therebetween.

On the other hand, if the CPU 61 determines that the humidity in the printer 1 is low (Step S10: YES), the CPU 61 then determines in S30 whether or not the sheet 3 is a thick sheet. In this case, the sheet 3 being a thick sheet is one example of "the sheet having high rigidity", and is one example of the special environment condition. For example, the sheet being a thick sheet means that the sheet has a thickness greater than or equal to 150 micrometers (μm). The sheet not being a thick sheet means that the sheet has a thickness less than 150 μm, for example. Incidentally, "the sheet has high rigidity" also means that the sheet 3 has high stiffness.

If the CPU 61 determines that the sheet 3 is not thick (S30: NO), the CPU 61 proceeds to the process in step S20. If the CPU 61 determines that the sheet 3 is thick (Step S30: YES), the CPU 61 then determines in S40 whether or not the sheet 3 has a small width. The sheet 3 having a small width is one example of the special environment condition. The sheet 3 having a small width means that the sheet has a postcard size, for example. The sheet 3 not having a small width means that the sheet has an A4 size or a letter size.

If the CPU 61 determines that the sheet 3 does not have a small width, or that the sheet 3 has a large width (S40: NO), the CPU 61 then proceeds to the process in S20. If the CPU 61 determines that the sheet 3 has a small width (S40: YES), the CPU 61 determines in S50 whether or not a current value setting request for setting a first current value has been made by a user through the operation panel 6. When a user wants to reduce effects of electric discharge onto the image quality, he/she operates the operation panel 6 to input a current value setting request to the printer 1. It is noted that especially during the black-white mode, if black toner is scattered on the sheet 3 due to the electric discharge, quality of a resultant black-white image becomes extremely degraded. It is therefore expected that especially during the black-white mode.

If the CPU 61 determines that there is no current value setting request from a user (S50: NO), the CPU 61 sets in S60 the transfer current It for each color using the "special environment current value table (1)" shown in FIG. 5, based on the type of the print mode set for the present print job, i.e. the black-white mode or multi color mode. Then, in S80 the CPU 61 controls the transfer voltage applying circuit 62 for each color by using the current value set in S60, and controls the image formation unit 20 to perform an image formation process to form an image on the sheet 3 in the print mode set for the present print job.

Incidentally, in the present embodiment, the "special environment" means an environment that satisfies the special environment condition. For example, the special environment is such an environment in which the humidity in the printer 1 is low, the sheet 3 is a thick sheet, and the sheet 3 has a small width. The "normal environment" is an environment that does not satisfy the special environment condition. An example of the "normal environment" is that the humidity in the printer 1 is not low.

On the other hand, if it is determined that there is a current value setting request from a user (S50: Yes), the CPU 61 sets the current value for black in the black-white mode by changing the current value "−15 μA" listed in the "special environment current value table (1)" to "−20 μA", which is an example of a "first current value". The CPU 61 sets the other transfer currents It by using the current values listed in the "special environment current value table (1)" without changing these current values. In this manner, if the electric discharge during separation of the sheet 3 from the conveyer belt 38 is likely to affect the image quality, a user can appropriately control the printer 1 to set the first current value by inputting the current value setting request to the printer 1 through the operation panel 6.

When the process in S80 is executed after the process in S70, the CPU 61 controls the transfer voltage applying circuits 62 for cyan, magenta, and yellow by using the current values for cyan, magenta, and yellow listed in FIG. 5; and controls the transfer voltage applying circuit 62 for black by using the current value (first current value) for black that is set in response to the current value setting request in S70.

The current value for black in the black-white mode that is set in S70 to "−20 μA" is an example of the first current value. That is, the transfer current value that is set for the transfer roller 39K (one example of a second transfer unit) in response to the current value setting request when the black-white mode is set and the CPU 61 determines that the special environment condition is satisfied is an example of the first current value. The transfer roller 39K confronts the photosensitive drum 30K via the conveyor belt 38. The photosensitive drum 30K is disposed at the most downstream position among the four photosensitive drums 30 in the conveying direction of the sheet 3.

As shown in FIG. 4, the current value that is set for the transfer roller 39K when the black-white mode is set and the CPU 61 determines that the special environment condition is not satisfied is an example of the second current value.

As shown in FIG. 5, the transfer current value that is set for the transfer roller 39K when the multi color mode is set and the CPU 61 determines that the special environment condition is satisfied is an example of the third current value.

As shown in FIG. 4, the transfer current value that is set for the transfer roller 39K when the multi color mode is set and the CPU 61 determines that the condition is not satisfied is an example of the fourth current value.

In S70, the CPU 61 sets the first current value so that the absolute value of a difference between the first current value and the second current value is greater than the absolute value of a difference between the third current value and the fourth current value. That is, the first current value is set so as to satisfy the following inequality expression (1):

$$|(\text{First current value})-(\text{Second current value})|>|(\text{Third current value})-(\text{Fourth current value})| \quad (1)$$

Specifically, as shown in FIGS. 4 and 5, the second current value is "−12 μA"; the third current value is "−15 μA"; and the fourth current value is "−12 μA." The first current value is set to, "−20 μA" in S70. In this case, $$|(\text{First current value})-(\text{Second current value})|=|-20-(-12)|=8$$

$$|(\text{Third current value})-(\text{Fourth current value})|=|-15-(-12)|=3$$

The inequality expression (1) is therefore satisfied.

Through executing the process in S70, the CPU 61 sets the first current value so that the first current value changes depending on the humidity. That is, the CPU 61 sets the first current value so that the absolute value of the first current value increases as the humidity decreases. On the other hand, if the black-white mode is set and the CPU 61 determines that the special environment condition is satisfied (YES in S10, S30, and S40), the CPU 61 sets in S70 the transfer current values for the transfer rollers 39Y, 39M, and 39C so that the current values are maintained unchanged regardless of changes in the humidity. That is, for the transfer rollers 39Y, 39M, and 39C in the black-white mode, the transfer current values are set to the same value of, "−3 μA" both in the normal environment current value table of FIG. 4 and in the special environment current value table (1) of FIG. 5. That is, the transfer current values for these transfer rollers 39Y, 39M, 39C are maintained as constant values both in the low humidity environment and the normal (medium or high) humidity environment. This ensures that the image quality in the black-white mode can be maintained without being affected by changes in the humidity. It is noted that the transfer current value for each transfer roller 39Y, 39M, or 39C is not necessarily equal between the low humidity environment and the normal environment. For example, the transfer current value for each transfer roller 39Y, 39M, or 39C may be different by some amounts, e.g. approximately "−1 μA", between the low humidity environment and the normal environment.

Moreover, the CPU 61 sets in S70 the transfer current value for each of the transfer rollers 39Y, 39M, and 39C, such that the absolute value of the transfer current value in the black-white mode is smaller than the absolute value of the corresponding transfer current value in the multi color mode. That is, as shown in FIG. 5, for the transfer roller 39Y, the transfer current value is set to "−3 μA" in the black-white mode, and is set to "−10 μA" in the multi color mode. For the transfer roller 39M, the transfer current value is set to "−3 μA" in the black-white mode, and is set to "−12 μA" in the multi color mode. Further, for the transfer roller 39C, the transfer current value is set to "−3 μA" in the black-white mode, and is set to "−12 μA" in the multi color mode. In this manner, the transfer current values for the transfer rollers 39Y, 39M, and 39C (first transfer units) are set such that the absolute values of the transfer current values are higher in the multi color mode than in the black-white mode. The transfer current values that are applied to the transfer rollers 39Y, 39M, and 39C during the white-black mode are such values that can cause the transfer rollers 39Y, 39M, and 39C to attract the sheet 3 onto the conveyor belt 38. Contrarily, the transfer current values that are applied to the transfer rollers 39Y, 39M, and 39C during the multi color mode are such values that can cause the transfer rollers 39 not only to attract the sheet 3 onto the conveyor belt 38 but also to transfer toner from the photosensitive drums 30 onto the sheet 3.

In this way, for each of the first transfer rollers 39C, 39M, 39Y, the absolute value of the transfer current value is smaller in the black-white mode than in the multi color mode. Therefore, the amount of force by which the sheet is attracted to the conveyer belt is smaller in the black-white mode than in the multi color mode. Therefore, the electric discharge that possibly occurs when the sheet separates from the conveying body is more liable to affect the image quality in the black-white mode than in the multi color mode. According to the first example, the absolute value of the current value for the transfer roller 39K is set greater in the black-white mode than in multi color mode. This can restrain the image quality from being affected by the electric discharge that occurs during separation of the sheet from the conveyer belt.

The "special environment current value table (1)" may be prepared, such that "−20 μA" rather than "−15 μA" is set as the current value for black in the black-white mode, similarly to the third example, which will be described later with referring to FIG. 9. In such a case, if it is determined that there is a current value setting request from a user (S50: YES), the absolute value of the first current value may be changed in S70 from "−20 μA" to "−23 μA", for example. That is, the absolute value of the first current value that is set in S70 in response to the request is greater than the absolute value of the first current value that is set in S60 when the request is not received. In this manner, when the electric discharge that possibly occurs during separation of the sheet 3 from the conveyer belt 38 is likely to affect the image quality, a user can appropriately reset the first current value by inputting the transfer current setting request through the operation panel 6.

3-2. Second Example

Figure 6:
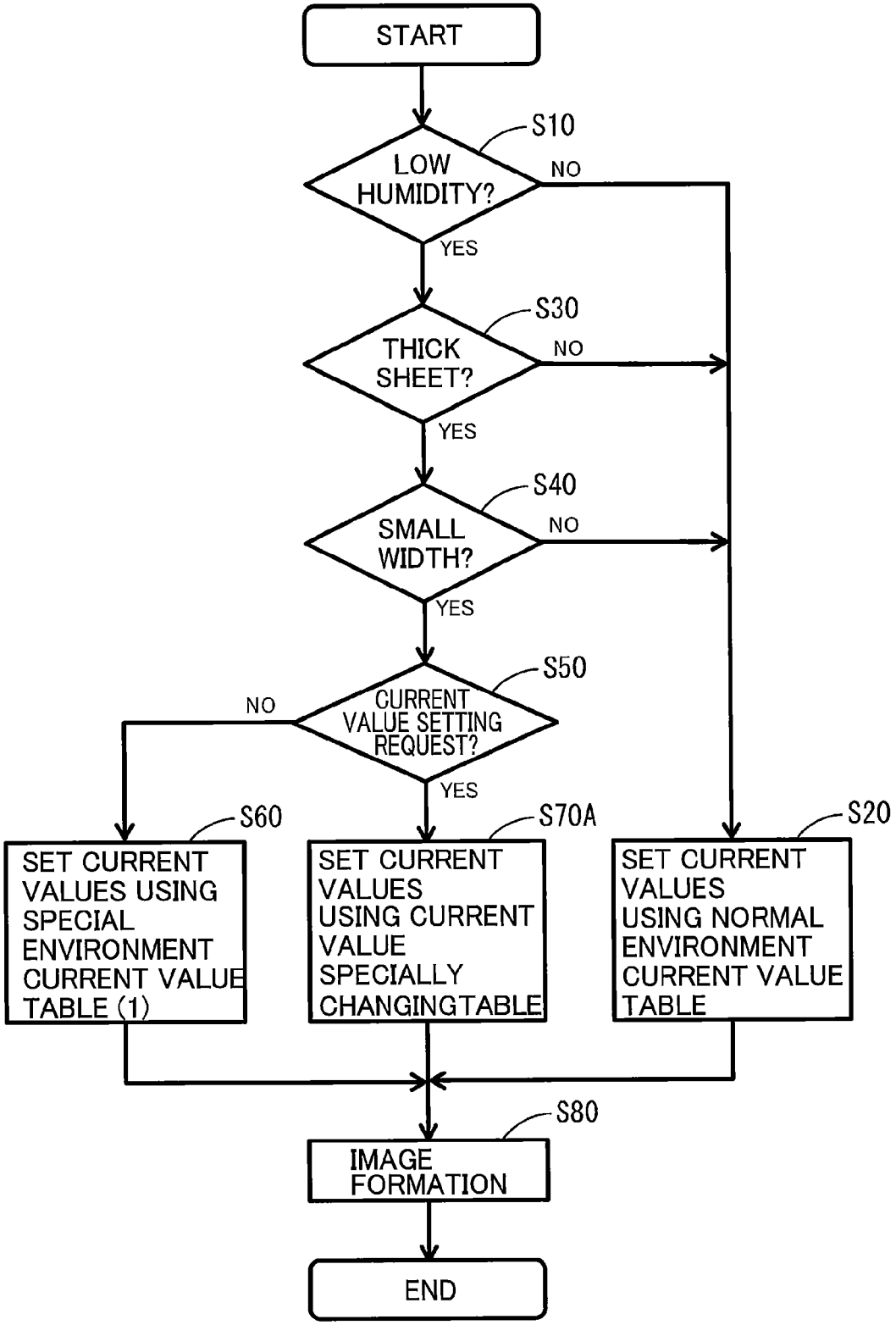
FIG. 6 is a flowchart illustrating steps in a transfer current setting process according to a second example.

With reference to FIGS. 6 and 7, the transfer current setting process according to the second example will be described. The transfer current setting process according to the second example is different from the first example in that the process in S70A shown in FIG. 6 is performed instead of the process in S70 shown in FIG. 3, and in that a "current value specially changing table" shown in FIG. 7 is stored in the memory 65 in addition to the tables shown in FIGS. 4 and 5. In FIG. 6, the same processes as those in FIG. 3 are represented by the same step reference symbols, and the explanations for those will be omitted.

According to the second example, if the CPU 61 determines that there is a current value setting request from a user (Step S50: YES), in S70A the CPU 61 uses the "current value specially changing table" shown in FIG. 7 to set the transfer current It for each transfer roller.

The "current value specially changing table" is different from the "special environment current value table (1)" in FIG. 5 in that the current value for black color in the black-white mode is already set to, e.g. "−20 μA" as the first current value. According to the second example, therefore, when a user makes a current value setting request (YES in S50), in S60A the CPU 61 merely uses the first current value that is previously set in the "current value specially changing table" for black in the black-white mode. Accordingly, the CPU 61 does not need to change the current value for black in the black-white mode, which is stored in the table shown in FIG. 5. This process reduces a load on the CPU 61 associated with the transfer current setting process, when compared with the first example.

3-3. Third Example

Figure 8:
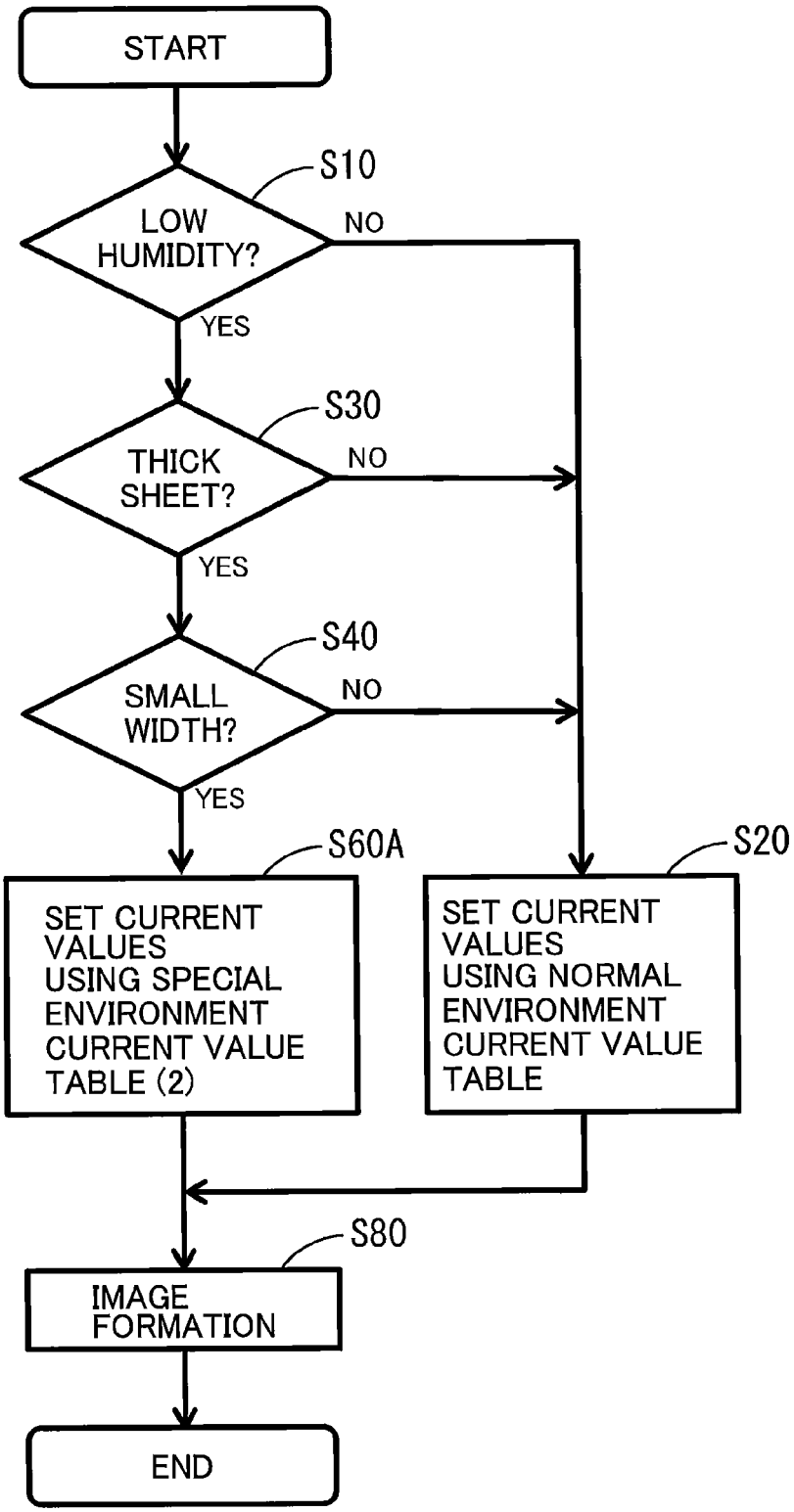
FIG. 8 is a flowchart illustrating steps in a transfer current setting process according to a third example.

Next, with reference to FIGS. 8 and 9, a transfer current setting process according to the third example will be described. The third example is different from the first example in that: processes in S50 and S70 shown in FIG. 3 are omitted; and that a process in S60A shown in FIG. 8 is performed instead of the process in S60 shown in FIG. 3. In FIG. 8, the same processes as those in FIG. 3 are represented by the same step reference symbols, and will not be described again. A "special environment current value table (2)" shown in FIG. 9 is stored in the memory 65 in place of the "special environment current value table (1)" shown in FIG. 5.

That is, according to the third example, the process in S50 for judging whether the current value setting request is received from a user and its relevant process in S70 in the first example are omitted.

According to the third example, if the CPU 61 determines that the sheet 3 has a small width (Step S40: YES), in S60A, the CPU 61 uses the "special environment current value table (2)" shown in FIG. 9 to set the transfer current It for each transfer roller 39.

On the "special environment current value table (2)", the current value for black in the black-white mode is already set to "−20 μA" as the first current value. That is, according to the third example, if the special environment condition is satisfied (Step 10: YES, Step 30: YES, Step 40: YES), the transfer currents It for the transfer rollers 39 are simply set based on the "special environment current value table (2)" shown in FIG. 9.

As a modification of the third example, the CPU 61 may set in S60A the first current value so that the absolute value of the first current value becomes larger as the humidity decreases. For example, when the humidity decreases, the CPU 61 may change in S60A the first current value "−20 μA" to "−25 μA" or "−30 μA". Accordingly, the CPU 61 can more precisely respond to the humidity change, thereby restraining the electric discharge from affecting the image quality when the sheet 3 is separated from the conveyor belt 38.

According to the first through third examples of the transfer current setting process, if the special environment condition is satisfied (Step 10: YES, Step 30: YES, Step 40: YES), the CPU 61 can set in S70, S70A, or S60A the first current value to such a value (−20 μA, for example) that an absolute value of a difference between the first and second current values is larger than an absolute value of a difference between the third and fourth current values. Then, in S80, the CPU 61 performs the image formation by using the thus set first current value if the print mode is set to the black-white mode. The amount of increment in the transfer current It for the transfer roller 39K from the normal environment (default value) to the special environment is larger in the black-white mode printing (8 μA) than in the multi color mode printing (3 μA). In this manner, the increment amount from the normal environment to the special environment differs between the multi color mode and black-white mode. Thus, even when the special environment condition is satisfied, the CPU 61 can restrain the electric discharge from affecting the image quality, particularly in the black-white mode. During the multi color mode, the amount of black toner that is used for image formation is smaller than the amount of toner in other colors used for image formation. So, even if black toner is scattered due to electric discharge during the multi color mode, the scattered black toner does not outstand in the resultant multi color image. Contrarily, during the black-white mode, if black toner is scattered due to electric discharge, the scattered black toner outstands in the resultant black-white. So, the electric discharge affects the image quality to a greater degree during the black-white mode than during the multi color mode.

Further, only when the special environment condition is satisfied, the transfer current value for the transfer roller 39K is set so that the absolute value of the transfer current value is higher than when the special environment condition is not satisfied. Therefore, only when it is necessary, the CPU 61 increases the absolute value of the transfer current value to restrain the electric discharge from affecting the image quality.

The special environment condition includes a condition that the humidity in the printer 1 is relatively low (S10: YES). That is, in the case where the humidity is relatively low, the electric discharge that possibly occurs during separation of the sheet 3 from the conveyer belt 38 is likely to affect the image quality, compared with the case where the humidity is high. Low humidity is more likely to cause the electric discharge to occur in comparison with high humidity when the sheet 3 is separated from the conveyor belt 38. Therefore, when the humidity is low, by setting the absolute value of the transfer current value for the transfer roller 39K higher than when the humidity is medium or high (normal environment), it is possible to enhance transfer ability of black toner (K) onto the sheet 3. In this manner, even if the electric discharge occurs during separation of the sheet 3 from the conveyor belt 38, the printer 1 can restrain black toner (K) from scattering due to the electric discharge and from affecting the image quality.

The special environment condition also includes that the sheet 3 is relatively thick, that is, the sheet 3 has relatively high rigidity (S30: YES). That is, in the case where if the sheet has high rigidity, the electric discharge is likely to affect the image quality when the sheet 3 is separated from the conveyor belt 38, compared with the case where the sheet has low stiffness. That is, it is empirically known that in comparison with a sheet having low rigidity, a sheet having high rigidity is more liable to cause an electric discharge to occur, when the sheet is separated from the conveyor belt 38. More specifically, when the leading end of the sheet 3 in the conveying direction reaches the fixing device 42 and becomes nipped between the heating roller 43 and pressure roller 44, the sheet 3 starts being pulled by the rollers 43 and 44 from the conveyor belt 38 toward the fixing unit 42, that is, in a direction obliquely upward and rearward. If the sheet 3 has high rigidity, the rigid sheet 3 is unable to be bent or curved, and therefore part of the rigid sheet 3 that has still remained on the conveyor belt 38 is compulsively separated upwardly from the conveyor belt 38. As a result, electric discharge is generated between the sheet 3 and the conveyor belt 38. It is noted that if the sheet 3 has low rigidity and therefore is flexible, the sheet 3 can be bent or curved. So, when the sheet 3 is pulled by the rollers 43 and 44 upward and rearward toward the fixing unit 42, the sheet 3 is gradually separated from the conveyor belt 38. At this time, electric discharge is also generated between the sheet 3 and the conveyor belt 38. However, the voltage of the electric discharge which is generated between the rigid sheet and the conveyor belt 38 is greater than the electric discharge which is generated between the flexible sheet and the conveyor belt 38. So, the electric discharge generated on the rigid sheet is more liable to affect image quality, in comparison with the electric discharge generated on the flexible sheet. Therefore, when the sheet has high rigidity, by setting the absolute value of the transfer current value for the transfer roller 39K higher than when the sheet has low rigidity (the normal environment), it is possible to increase the amount of force by which toner is attracted toward the sheet 3. In other words, it is possible to enhance transfer ability of black toner (K) onto the sheet 3. In this manner, even if the electric discharge occurs during separation of the sheet 3 from the conveyor belt 38, the printer 1 can restrain the electric discharge from affecting the image quality.

The special environment condition includes a condition that the sheet 3 has a relatively small width (S40: YES). That is, in the case where the sheet has a relatively small width, the electric discharge is likely to affect the image quality, compared with the case where the sheet has a relatively large width. That is, it is empirically known that in comparison with a sheet having a large width, a sheet having a small width is more likely to cause the electric discharge to occur when the sheet 3 is separated from the conveyor belt 38. Therefore, when the sheet has a relatively small width, by setting the absolute value of the transfer current value for the transfer roller 39K higher than when the sheet has a relatively large width (normal environment), it is possible to enhance the transfer ability of black toner (K) onto the sheet 3. In this manner, even when an electric discharge occurs due to separation of the sheet 3 from the conveyor belt 38, the printer 1 can restrain the electric discharge from affecting the image quality. Examples of the sheet that has relatively high rigidity and a relatively small width include a postcard. The above-described examples are therefore especially suitable for printing postcards.

Modifications

Modification (1)

In the above-described examples, the process of setting the transfer current values (Steps S60, S60A, S70, and S70A) for suppressing effects of the electric discharge is executed selectively based on the three determination processes in steps S10, S30, and S40 (three conditions). However, the present invention is not limited to these settings.

At least one of the three determination processes (at least one of the conditions) of S10, S30, and S40 may be executed. That is, two of these three determination processes may be omitted. For example, only the process in S10 may be performed as the determination process. In this case, the process in S10 is performed in the transfer current setting process. If the determination result in S10 is negative (S10: NO), then the process in S20 is carried out. If the determination result in S10 is affirmative (S10: YES), the process in S50 and subsequent processes are executed in the procedure shown in FIGS. 3 and 6, or the process in S60A and subsequent processes are executed in the procedure shown in FIG. 8.

Alternatively, the processes in S30 and S40 may be omitted. In this case, if the determination result in S10 is affirmative (Step S10: YES), then the CPU 61 may proceed to the process in S50 or S60 and subsequent processes.

Alternatively, only the process in S40 may be omitted.

Additionally, the processes in S40 and S50 may be omitted. In this case, if the determination result of the process in S10 is affirmative (S10: YES), then the CPU 61 may proceed to the process in S30. If the determination result in S30 is affirmative (Step S30: YES), then process in S60 or S60A and the process in S80 is executed.

Modification (2)

In the above-described examples, the photosensitive drum 30K that carries developer in black is disposed at the most downstream position in the sheet conveying direction. However, the present invention is not limited to this arrangement. That is, any photosensitive drum 30Y, 30M, or 30C (as an example of a second photosensitive body to carry a developer of a predetermined color), other than the photosensitive drum 30K may be disposed at the most downstream position in the conveying direction of the sheet 3. For example, FIGS. 10 and 11 show a "normal environment current value table" and a "special environment current value table" that are used in the case where the photosensitive drums 30K, 30Y, 30M, and 30C are arranged in this order in the conveying direction of the sheet 3 and therefore the photosensitive drum 30C is disposed on the most downstream position among the photosensitive drums 30C, 30M, 30Y and 30K in the sheet conveying direction.

In this modification, the transfer roller 39K serves as an example of the first transfer unit. The transfer roller 39C serves as an example of the second transfer unit.

In this modification (2), the transfer current value for the transfer roller 39C is set as described below. That is, in the case where the multi color mode is set and the special environment condition is satisfied, the transfer current value for the transfer roller 39C is set to the first current value (−20 μA). In the case where the multi color mode is set and the special environment condition is not satisfied, the transfer current value for the transfer roller 39C is set to the second current value (−12 μA). In the case where the black-white mode is set and the special environment condition is satisfied, the transfer current value for the transfer roller 39C is set to the third current value (−15 μA). In the case where the black-white mode is set and the special environment condition is not satisfied, the transfer current value for the transfer roller 39C is set to the fourth current value (−12 μA).

In this modification (2), the CPU 61 sets the first to fourth current values as shown in FIGS. 10 and 11 so that the first to fourth current values satisfy the inequality expression (1) described above. During the image formation process, the CPU 61 uses the first current value (−20 μA) for the transfer roller 39C to form an image in the multi color mode.

For example, the normal environment current value table shown in FIG. 10 and the special environment current value table shown in FIG. 11 may be stored in the memory 65. The transfer current setting process shown in FIG. 8 may be modified such that the transfer current values are set in S20 by using the normal environment current value table of FIG. 10, and the transfer current values are set in S60A by using the special environment current value table of FIG. 11. Alternatively, the transfer current setting process shown in FIG. 3 may be modified such that the transfer current values are set in S20 by using the normal environment current value table of FIG. 10, the transfer current values are set in S60 by using the special environment current value table of FIG. 11, and the transfer current values are set in S70 by using the special environment current value table of FIG. 11 and changing the first current value from "−20 μA" to "−23 μA", for example. During the multi color mode, if cyan toner is scattered due to electric discharge, the scattered cyan toner outstands in the formed image. However, by setting the current value for the transfer roller 39C to the first current value, it is possible to restrain cyan toner from being scattered due to the electric discharge.

In a manner similar to that described above, even if any photosensitive drum, 30Y, 30M, or 30C (other than 30K) is disposed at the most downstream position among the photosensitive drums, 30Y, 30M, 30C, and 30K in the conveying direction of the sheet 3, the printer 1 can form an image in the multi color mode while restraining an electric discharge from affecting the image quality during separation of the sheet 3 from the conveyer belt 38.

Modification (3)

According to the above-described examples and modifications (1) and (2), the color of toner used in the photosensitive drum 30 that is disposed at the most downstream position in the sheet conveying direction is specified. However, the present invention is not limited to these examples. That is, the transfer current setting process can be executed in a manner described below, regardless of the color of toner used by the photosensitive drum 30 disposed at the most downstream position in the sheet conveying direction. It is noted that in the present modification (3), the user can set a single color mode in place of the black-white mode. The single color mode is such a mode in which only the photosensitive drum 30 that is disposed at the most downstream position among the four photosensitive drums 30 in the sheet conveying direction is used to form an image using toner of the corresponding single color.

In this modification (3), the printer 1 includes: the conveyor belt 38 that conveys the sheet 3, a plurality of photosensitive drums 30, a plurality of transfer rollers 39, the operation panel 6, and the CPU 61. The photosensitive drums 30 face a surface of the conveyor belt 38 that carries the sheet 3 thereon. The photosensitive drums 30 include a first photosensitive drum that carries a developer image of a first color and a second photosensitive drum carrying a developer image in a second color. The second photosensitive drum is one of the plurality of photosensitive drums that is disposed at the most downstream position among the plurality of photosensitive drums in the conveying direction of the sheet 3. The transfer rollers 39 are positioned corresponding to the plurality of photosensitive drums 30, and includes a first transfer roller configured to transfer the first-color developer image carried by the first photosensitive drum to the sheet 3 on the conveyor belt 38 and a second transfer roller configured to transfer the second-color developer image carried by the second photosensitive drum to the sheet 3 on the conveyor belt 38.

The CPU 61 performs: a determination process, a reception process, and a image formation process. The determination process determines whether or not the special environment condition is satisfied. The reception process receives a request for setting a transfer current value for the second transfer roller via the operation panel 6. The setting process sets the transfer current value for the second transfer roller. If the special environment condition is satisfied, the transfer current value for the second transfer roller is set such that the absolute value of the transfer current value that is set when the request is received (e.g., −20 μA) is greater than the absolute value of the transfer current value that is set when no request is received (e.g., −15 μA). The image formation process is executed to form an image using the current value set by the setting process.

For example, a "normal environment current value table" shown in FIG. 12A, a "special environment current value table" shown in FIG. 12B, and a "current value specially changing table" shown in FIG. 12C may be stored in the memory 65. The "normal environment current value table" of FIG. 12A is the same as the normal environment current value table of FIG. 4 except that colors of the respective photosensitive drums 30 which are arranged from the most upstream position (first position) to the most downstream position (fourth position) in the sheet conveying direction are not specified. For example, for the single color mode, the current values of "−3 μA" are set to three transfer rollers 39 that are arranged first through third in the conveying direction among all of the four transfer rollers 39, and the current value of "−12 μA" is set to the most downstream transfer roller 39 that is disposed fourth in the conveying direction. Similarly, the "special environment current value table" shown in FIG. 12B is the same as the special environment current value table of FIG. 5 except that colors of the respective photosensitive drums 30 are not specified. The transfer current setting process shown in FIG. 3 may be modified such that the transfer current values are set in S20 by using the "normal environment current value table" of FIG. 12A, the transfer current values are set in S60 by using the "special environment current value table" of FIG. 12B, and the transfer current values are set in S70 by using the current value specially changing table of FIG. 12C.

In this modification (3), regardless of the print mode and the color of toner used on the photosensitive drum 30 positioned at the most downstream position in the sheet conveying direction, the printer 1 further increases the transfer current value for the second transfer roller from the transfer current value under the special environment condition, responding to a received request. As a result, the electric discharge is restrained from affecting the image quality during the separation of the sheet 3 from the conveyor belt 38.

Moreover, in this modification (3), as the determination process of determining whether or not the special environment condition is satisfied, the CPU 61 may determine whether or not the printer 1 is at the single color mode, instead of judging whether the humidity in the printer 1 is low, whether the sheet 3 is a thick sheet, and whether the sheet has a small width.

For example, a "multi-color-mode current value table" shown in FIG. 13A, a "single-color-mode current value table" shown in FIG. 13B, and a "single-color-mode current value specially changing table" shown in FIG. 13C may be stored in the memory 65. The transfer current setting process shown in FIG. 3 may be modified in a manner described below.

That is, the processes of S30 and S40 are omitted. In S10, the CPU 61 judges whether the single color mode is set, instead of judging whether the humidity in the printer 1 is low. If the single color mode is set, the judgment in S10 becomes positive (yes in S10) and the process proceeds to S50. If the multi color mode is set, the judgment in S10 becomes negative (no in S10) and the process proceeds to S20. The transfer current values are set in S20 by using the "multi-color-mode current value table" of FIG. 13A. The transfer current values are set in S60 by using the "single-color-mode current value table" of FIG. 13B. The transfer current values are set in S70 by using the "single-color-mode current value specially changing table" of FIG. 13C. Accordingly, if the current value setting request is not received in the single color mode (S60), the absolute value of the transfer current value for the transfer roller 39 at the most downstream position is set larger than in the multi color mode (FIG. 13B). Additionally, if the current value setting request is received in the single color mode, the absolute value of the transfer current value for the transfer roller 39 at the most downstream position is set larger in S70 than in S60 (FIG. 13C).

The CPU 61 determines that the special environment condition is satisfied if the single color mode is set as the print mode. Therefore, the printer 1 can restrain the electric discharge from affecting the image quality when the single color mode is set. That is, it is empirically known that the electric discharge occurring when the sheet 3 is separated from the conveyor belt 38 is liable to affect the image quality during the single color mode, in comparison with the multi color mode. During the single color mode, the transfer current values corresponding to the colors that are not used in the image formation are set to be smaller than in the multi color mode. So, in the single color mode, the sheet 3 is attracted to the conveyor belt 38 with a smaller amount of force than in the multi color mode. By increasing the absolute value of the transfer current values for the transfer roller on the most downstream position, it is possible to restraining the electric discharge from affecting the image quality during separation of the sheet 3 from the conveyor belt 38.

While the present invention has been described in detail with reference to the embodiments thereof, it would be apparent to those skilled in the art that various changes and modifications may be made therein without departing from the spirit of the invention.

What is claimed is:

1. An image forming apparatus comprising:

a conveying body configured to convey a sheet in a conveying direction, the conveying body having a surface to support the sheet thereon;

a plurality of photosensitive bodies configured to be arranged facing the surface of the conveying body and including:

a first photosensitive body configured to bear thereon a developer image in a predetermined color, and a second photosensitive body configured to bear thereon a developer image in black and positioned at a most downstream position among the plurality of the photosensitive bodies in the conveying direction;

a plurality of transfer units provided in one to one correspondence with the plurality of photosensitive bodies, the transfer units including:

a first transfer unit disposed corresponding to the first photosensitive body and configured to transfer the developer image in the predetermined color from the first photosensitive body to the sheet supported on the conveying body; and a second transfer unit disposed corresponding to the second photosensitive body and configured to transfer the developer image in black from the second photosensitive body to the sheet supported on the conveying body;

a memory storing prescribed current values; and a control device configured to perform:

determining whether at least one of conditions that a humidity in the image forming apparatus is less than a prescribed humidity, that the sheet has a thickness greater than or equal to a prescribed thickness, and that the sheet has a width smaller than a prescribed width is satisfied;

when a black-white mode is set and at least one of the conditions is satisfied, setting a first current value as an amount of transfer current to be applied to the second transfer unit, the black-white mode being defined as a mode where a developer image is formed by using developer in black only;

when the black-white mode is set and none of the conditions are satisfied, setting a second current value as an amount of transfer current to be applied to the second transfer unit;

when a multi color mode is set and at least one of the conditions is satisfied, setting a third current value as an amount of transfer current to be applied to the second transfer unit, the multi color mode being defined as a mode where a developer image is formed by using developer in a plurality of colors including the predetermined color and the black;

when the multi color mode is set and none of the conditions are satisfied, setting a fourth current value as an amount of transfer current to be applied to the second transfer unit; and forming an image by applying transfer current of the set current value to the second transfer unit, the second through fourth current values being the prescribed current values stored in the memory, the first current value being set such that an absolute value of a difference between the first current value and the second current value is greater than an absolute value of a difference between the third current value and the fourth current value.

2. The image forming apparatus according to claim 1, wherein the memory further stores additional prescribed current values including a black-white transfer current value and a color transfer current value such that an absolute value of the black-white transfer current value is smaller than an absolute value of the color transfer current value, the black-white transfer current value defined as an amount of a transfer current to be applied to the first transfer unit when the black-white mode is set, the color transfer current value defined as an amount of a transfer current to be applied to the first transfer unit when the multi color mode is set; and wherein the control device further sets:

the black-white transfer current value when the black-white mode is set, and the color transfer current value when the multi color mode is set.

3. The image forming apparatus according to claim 1, wherein the control device sets the first current value so that an absolute value of the first current value increases as the humidity in the image forming apparatus decreases.

4. The image forming apparatus according to claim 3, wherein when the black-white mode is set and at least one of the conditions is satisfied, the control device maintains a black-white transfer current value as a constant value regardless of changes in the humidity in the image forming apparatus, the black-white transfer current value being defined as an amount of a transfer current to be applied to the first transfer unit when the black-white mode is set.

5. The image forming apparatus according to claim 1, further comprising an operation unit;

wherein the control device further judges whether a first current value setting request is received through the operation unit; and wherein the control device sets the first current value so that an absolute value of the first current value that is set for when the first current value setting request is received is greater than an absolute value of the first current value that is set for when the operation unit receives no current value setting request.

6. The image forming apparatus according to claim 1, wherein the second current value and the fourth current value are equal to each other.

7. An image forming apparatus comprising:

a conveying body configured to convey a sheet in a conveying direction, the conveying body having a surface to support the sheet thereon;

a plurality of photosensitive bodies configured to be arranged facing the surface of the conveying body and including:

a first photosensitive body configured to bear thereon a developer image in black, and a second photosensitive body configured to bear thereon a developer image in a predetermined color and positioned at a most downstream position among the plurality of the photosensitive bodies in the conveying direction;

a plurality of transfer units provided in one to one correspondence with the plurality of photosensitive bodies, the transfer units including:

a first transfer unit disposed corresponding to the first photosensitive body and configured to transfer the developer image in black from the first photosensitive body to the sheet supported on the conveying body; and a second transfer unit disposed corresponding to the second photosensitive body and configured to transfer the developer image in the predetermined color from the second photosensitive body to the sheet supported on the conveying body;

a memory storing prescribed current values; and a control device configured to perform:

determining whether at least one of conditions that a humidity in the image forming apparatus is lower than a prescribed humidity, that the sheet has a thickness greater than or equal to a prescribed thickness, and that the sheet has a width smaller than a prescribed width is satisfied;

when a multi color mode is set and at least one of the conditions is satisfied, setting a first current value as an amount of transfer current to be applied to the second transfer unit, the multi color mode being defined as a mode where a developer image is formed by using developer in a plurality of colors including the predetermined color and the black;

when the multi color mode is set and none of the conditions are satisfied, setting a second current value as an amount of transfer current to be applied to the second transfer unit;

when a black-white mode is set and at least one of the conditions is satisfied, setting a third current value as an amount of transfer current to be applied to the second transfer unit, the black-white mode being defined as a mode where a developer image is formed by using developer in black only;

when the black-white mode is set and none of the conditions are satisfied, setting a fourth current value as an amount of transfer current to be applied to the second transfer unit; and forming an image by applying transfer current of the set current value to the second transfer unit, the second through fourth current values being the prescribed current values stored in the memory, the first current value being set such that an absolute value of a difference between the first current value and the second current value is greater than an absolute value of a difference between the third current value and the fourth current value.

8. An image forming apparatus comprising:

a conveying body configured to convey a sheet in a conveying direction, the conveying body having a surface to support the sheet thereon;

a plurality of photosensitive bodies configured to be arranged facing the surface of the conveying body and including:

a first photosensitive body configured to bear thereon a developer image in a first color, and a second photosensitive body configured to bear thereon a developer image in a second color and positioned at a most downstream position among the plurality of the photosensitive bodies in the conveying direction;

a plurality of transfer units provided in one to one correspondence with the plurality of photosensitive bodies, the transfer units including:

a first transfer unit disposed corresponding to the first photosensitive body and configured to transfer the developer image in the first color from the first photosensitive body to the sheet supported on the conveying body; and a second transfer unit disposed corresponding to the second photosensitive body and configured to transfer the developer image in the second color from the second photosensitive body to the sheet supported on the conveying body;

an operation unit; and a control device configured to perform:

determining whether at least one of conditions that a humidity in the image forming apparatus is lower than a prescribed humidity, that the sheet has a thickness greater than or equal to a prescribed thickness, that the sheet has a width smaller than a prescribed width, and that a single color mode is set is satisfied, the single color mode being defined as a mode where a developer image is formed by using developer in the second color only;

judging whether a current value setting request requesting setting of a transfer current value for the second transfer unit is received through the operation unit; and when the current value setting request is received and at least one of the conditions is satisfied, setting the transfer current value for the second transfer unit to such a value that is greater than a transfer current value that is set for the case where the current value setting request is not received and at least one of the conditions is satisfied; and forming an image by using the transfer current value.

* * * * *